US012781305B2

(12) United States Patent
Liu et al.

(10) Patent No.: US 12,781,305 B2
(45) Date of Patent: Nov. 3, 2026

(54) METHOD AND EXTRACTION DEVICE FOR EXTRACTING AND PREPARING BATTERY-GRADE LITHIUM CARBONATE FROM P507 RAFFINATE

(71) Applicant: HUNAN JIN YUAN NEW MATERIALS JOINT STOCK COMPANY LIMITED, Yiyang (CN)

(72) Inventors: Xunbing Liu, Yiyang (CN); Can Peng, Yiyang (CN); Zhen Liu, Yiyang (CN); Quncheng Zhou, Yiyang (CN); Zi Wang, Yiyang (CN); Xiongwu Dong, Yiyang (CN); Shanmu Wu, Yiyang (CN); Jianjun Ouyang, Yiyang (CN)

(73) Assignee: HUNAN JIN YUAN NEW MATERIALS JOINT STOCK COMPANY LIMITED, Yiyang (CN)

( * ) Notice: Subject to any disclaimer, the term of this patent is extended or adjusted under 35 U.S.C. 154(b) by 494 days.

(21) Appl. No.: 18/476,064

(22) Filed: Sep. 27, 2023

(65) Prior Publication Data

US 2024/0018623 A1 Jan. 18, 2024

Related U.S. Application Data

(63) Continuation of application No. PCT/CN2022/087892, filed on Apr. 20, 2022.

(30) Foreign Application Priority Data

Apr. 25, 2021 (CN) ..... 202110446038.1

(51) Int. Cl.

| | |
|---|---|
| ***C22B 3/34*** | (2006.01) |
| ***C22B 3/22*** | (2006.01) |
| ***C22B 26/12*** | (2006.01) |

(52) U.S. Cl.

CPC ..... *C22B 3/34* (2021.05); *C22B 3/22* (2013.01); *C22B 26/12* (2013.01)

(58) Field of Classification Search

None

See application file for complete search history.

(56) References Cited

FOREIGN PATENT DOCUMENTS

| | | |
|---|---|---|
| CN | 201704381 U | 1/2011 |
| CN | 202131345 U | 2/2012 |

(Continued)

OTHER PUBLICATIONS

English translation of CN-113003589-A Description. (Year: 2021).*

(Continued)

*Primary Examiner* — Anthony J Zimmer
*Assistant Examiner* — Zachary John Baum

(57) ABSTRACT

Disclosed are a method and device for extracting and preparing battery-grade lithium carbonate from a P507 raffinate. The method comprises steps of impurity adjustment, extraction, purification, reverse extraction, alkalization, crystallization, separation, drying, the impurity adjustment comprises: adjusting a pH value of the P507 raffinate to be 8.5 to 10.5 with lithium hydroxide or alkali, and filtering to obtain a filtrate for later use; the alkalization comprises: heating a lithium solution to 85° C. to 95° C., adding lithium hydroxide or alkali to adjust a pH value to be 9.0 to 13.0, maintaining a temperature at 85° C. to 95° C. and standing for 2 hours to 8 hours, and then filtering to obtain a filtrate for later use; and the crystallization comprises: introducing compressed air into the filtrate after alkalization, evaporating and concentrating at the same time, and discharging and cooling when fine crystals exist in the concentrated solution.

6 Claims, 3 Drawing Sheets

(56) References Cited

FOREIGN PATENT DOCUMENTS

| | | | | | |
|---|---|---|---|---|---|
| CN | 202387248 | U | | 8/2012 | |
| CN | 202849512 | U | | 4/2013 | |
| CN | 107058742 | A | | 8/2017 | |
| CN | 108408745 | A | | 8/2018 | |
| CN | 207793370 | U | | 8/2018 | |
| CN | 108517422 | A | | 9/2018 | |
| CN | 109576499 | A | | 4/2019 | |
| CN | 110066925 | A | | 7/2019 | |
| CN | 110616331 | A | | 12/2019 | |
| CN | 209798035 | U | | 12/2019 | |
| CN | 111057848 | A | | 4/2020 | |
| CN | 111099641 | A | | 5/2020 | |
| CN | 111519031 | A | | 8/2020 | |
| CN | 113003589 | A | * | 6/2021 | ..... B01D 11/0488 |
| CN | 214653684 | U | | 11/2021 | |
| JP | 2006057142 | A | * | 3/2006 | |
| WO | 9929624 | A1 | | 6/1999 | |

OTHER PUBLICATIONS

English translation of CN 108408745 A Description. (Year: 2018).*
English translation of CN 107058742 A Description. (Year: 2017).*
Internation Search Report of PCT/CN2022/087892, Mailed Jul. 26, 2022.
Virolainen, S. et al., "Solvent extraction fractionation of Li-ion battery leachate containing Li, Ni, and Co", Separation and Purification Technology, vol. 179, Feb. 6, 2017, pp. 274-282.

* cited by examiner

METHOD AND EXTRACTION DEVICE FOR EXTRACTING AND PREPARING BATTERY-GRADE LITHIUM CARBONATE FROM P507 RAFFINATE

CROSS-REFERENCE TO RELATED APPLICATIONS

This application is a continuation of International Patent Application No. PCT/CN2022/087892 with a filing date of Apr. 20, 2022, designating the United States, now pending, and further claims priority to Chinese Patent Application No. 202110446038.1 with a filing date of Apr. 25, 2021. The content of the aforementioned applications, including any intervening amendments thereto, are incorporated herein by reference.

TECHNICAL FIELD

The present invention relates to the technical field of non-ferrous metal wet metallurgy, and particularly to a lithium-ion extraction, purification and concentration crystallization technology.

BACKGROUND OF THE PRESENT INVENTION

When cathode materials of lithium-ion batteries are recycled by a wet method, a P507 extracting agent is used for extraction, and a raffinate contains more than 1 g/L of lithium. The lithium in the raffinate is generally recycled by precipitating and preparing lithium phosphate or lithium carbonate with trisodium phosphate or carbonate. A comprehensive yield of the lithium phosphate or the lithium carbonate prepared by this method is generally 70% to 90%. The purity of the prepared lithium product is low and cannot meet the standard of battery-grade lithium salt. A concentration of lithium ions in the solution after precipitation is still about 200 mg/L, and the solution needs to be continuously treated subsequently, which increases the difficulty of recycling and the difficulty of environmental protection treatment. Therefore, it is necessary to study a method and equipment to improve the recycling rate of the lithium in the P507 raffinate and the quality of the recycled product, so as to meet the requirements of high-quality lithium carbonate preparation and environmental protection treatment.

SUMMARY OF PRESENT INVENTION

Technical Problem

The present invention aims to overcome the shortcomings and defects mentioned in the above background, and disclose a method and extraction device for extracting and preparing battery-grade lithium carbonate from a P507 raffinate, which can effectively improve a recycling rate of lithium, wherein recycled and prepared lithium carbonate can meet battery-grade requirements, and a lithium content in a recycled raffinate is lower than 1 mg/L, thus significantly reducing the difficulty of environmental protection treatment.

Solution of Problem

Technical Solution

The first technical solution of the present invention is: a method for extracting and preparing battery-grade lithium carbonate from a P507 raffinate, which comprises the following steps of impurity adjustment, extraction, purification, reverse extraction, alkalization, crystallization, separation and drying, wherein: the impurity adjustment comprises: adjusting a pH value of the P507 raffinate to be 8.5 to 10.5, preferably 9 to 10, and 9.5, with lithium hydroxide or alkali, and filtering to obtain a filtrate for later use;

the extraction comprises: mixing the P507 after saponification with the above liquid after impurity adjustment and filtration, standing for phase separation after mixing, retaining an organic phase of the P507, detecting a concentration of lithium ions in a water phase, and sending the water phase for wastewater treatment when the concentration of lithium ions is less than 1 mg/L;

the purification comprises: purifying and washing the organic phase after the step of extraction with 0.1 mol/L to 0.25 mol/L lithium sulfate solution, preferably 0.2 mol/L lithium sulfate solution, standing for phase separation after washing, retaining an organic phase of the P507, and merging a water phase in the step of extraction;

the reverse extraction comprises: reversely extracting the organic phase of the P507 after purification and washing with dilute sulfuric acid, and carrying out two-phase separation to obtain a blank organic phase and a lithium sulfate solution;

the alkalization comprises: heating the lithium solution obtained by the step of reverse extraction to 85° C. to 95° C., preferably 90° C., adding lithium hydroxide or alkali to adjust a pH value to be 9.0 to 13.0, preferably 10.0 to 12.0, and 10.5 to 11.0, maintaining a temperature at 85° C. to 95° C., preferably 90° C., and standing for 2 hours to 8 hours, preferably 3 hours to 7 hours, 4 hours to 6 hours, 3 hours to 5 hours, and 4 hours, and then filtering to obtain a filtrate for later use; and the crystallization comprises: introducing compressed air into the filtrate after alkalization, with a pressure of the compressed air being 0.2 MPa to 0.8 MPa, preferably 0.3 MPa to 0.7 MPa, 0.4 MPa to 0.6 MPa, and 0.5 MPa, and an air flow rate of the compressed air being 8 $m^3$/h to 30 $m^3$/h, preferably 10 $m^3$/h to 25 $m^3$/h, 13 $m^3$/h to 22 $m^3$/h, 15 $m^3$/h to 20 $m^3$/h, and 16 $m^3$/h to 18 $m^3$/h, evaporating and concentrating at the same time, and discharging and cooling when fine crystal particles exist in the concentrated solution.

Further, the reverse extraction comprises: reversely extracting the organic phase of the P507 after purification and washing with dilute liquid alkali, and carrying out two-phase separation to obtain the blank organic phase and a lithium hydroxide solution.

The second technical solution of the present invention is: an extraction device for extracting and preparing battery-grade lithium carbonate from a P507 raffinate, which is provided with a stirring chamber, the stirring chamber is connected with a clarifying chamber through a transition groove, and a stirrer is arranged in the stirring chamber, wherein the stirring chamber is a cube, the clarifying chamber is a cuboid, a length-width ratio of the clarifying chamber is 4 to 5: 1, a volume ratio of the stirring chamber to the clarifying chamber is 1: 4.5 to 5.5, the stirrer consists of a main stirrer and an auxiliary stirrer, the main stirrer is provided with a double-layer cross-shaped stirring blade, the auxiliary stirrer is provided with a cylindrical stirring body, circular small holes with a diameter of 5 mm to 10 mm are evenly distributed in a wall of the cylindrical stirring body, and the stirring blade is sleeved in the cylindrical stirring body.

Further, a rotating speed of the main stirrer is 1,000 rpm to 2,000 rpm, preferably 1,200 rpm to 1,800 rpm, 1,300 rpm to 1,600 rpm, and 1,400 rpm to 1,500 rpm, and a rotating speed of the auxiliary stirrer 2 is 100 rpm to 200 rpm, preferably 120 rpm to 180 rpm, 140 rpm to 160 rpm, and 150 rpm.

Further, a diameter of the stirring blade of the main stirrer is 0.28 to 0.33 of a side length of the stirring chamber, and a diameter of the cylindrical stirring body of the auxiliary stirrer is 0.65 to 0.75 of the side length of the stirring chamber.

Further, one circular small hole is arranged on the wall every square centimeter.

Further, two slat-shaped flow stabilization bars are sequentially arranged in the clarifying chamber, a distance between a position of a first flow stabilization bar and an inlet end of a transition groove of the clarifying chamber is ¼ of a length of the clarifying chamber, and a distance between a position of a second flow stabilization bar in the length of the clarifying chamber and the inlet end of the transition groove of the clarifying chamber is ½ of the length of the clarifying chamber.

BENEFICIAL EFFECTS OF INVENTION

Beneficial Effects

Due to the adoption of the above technical solutions, the present invention has the following advantages: (1) due to the adoption of the above extraction method, the concentration of lithium ions in the raffinate is as low as 1 mg/L, which significantly reduces the difficulty of wastewater treatment.

(2) Due to the adoption of the extraction method and the alkalization-air precipitation method, the recycling rate of lithium is improved, and the recycling rate of lithium is more than 99%.

(3) Because the adoption of the extraction and separation method improves the purity of the lithium salt solution, it is ensured that the quality of the lithium carbonate product produced by precipitation meets battery-grade requirements.

(4) Because the adoption of the alkalization-air precipitation method avoids introduction of impurity ions, the purity of the product is further ensured and improved, so that the lithium carbonate product completely meets battery-grade requirements.

DESCRIPTION OF THE DRAWINGS

Brief Description of the Drawings

Figure 1:
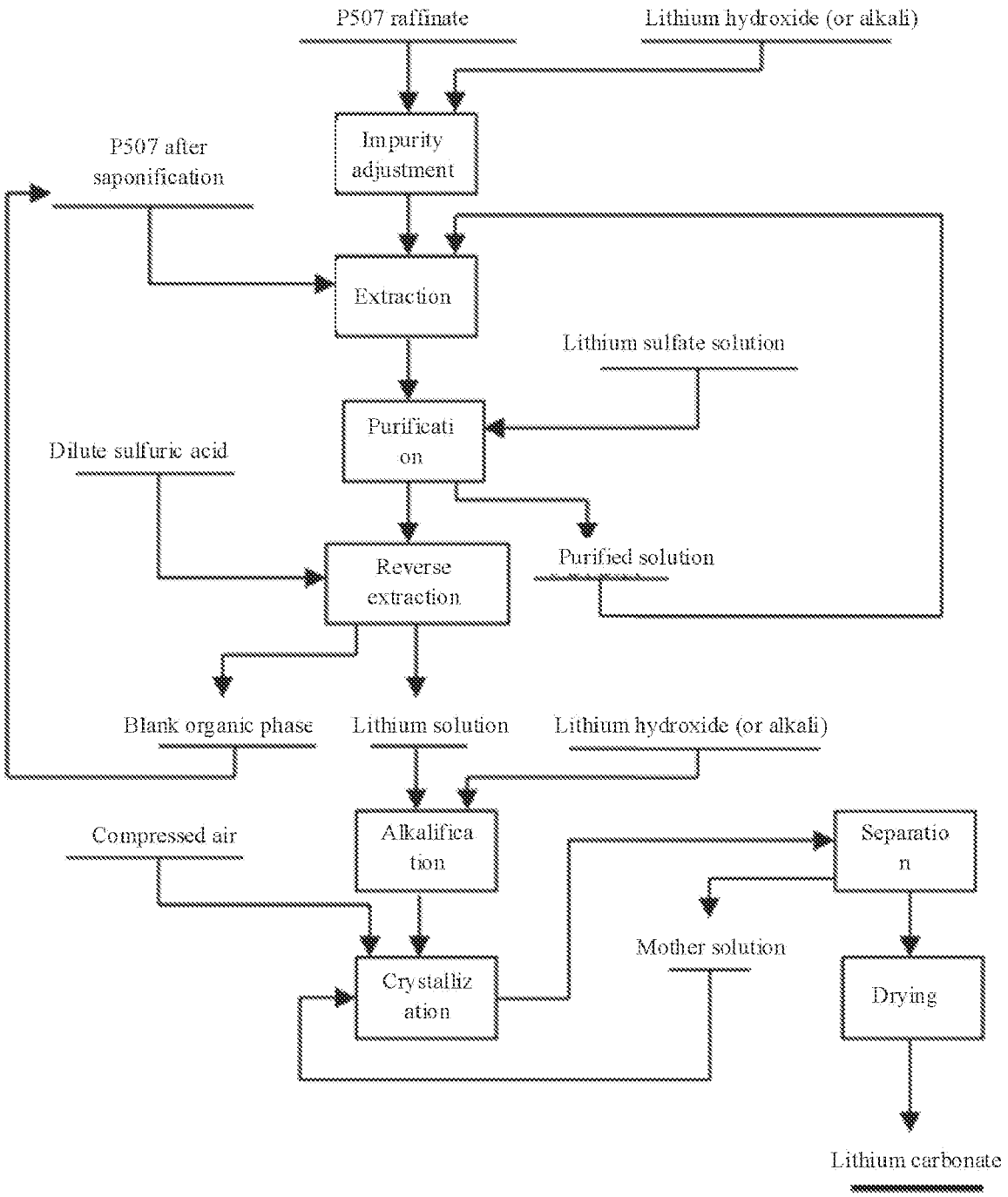

FIG. 1 is a technological flow chart of the present invention.

Figure 2:
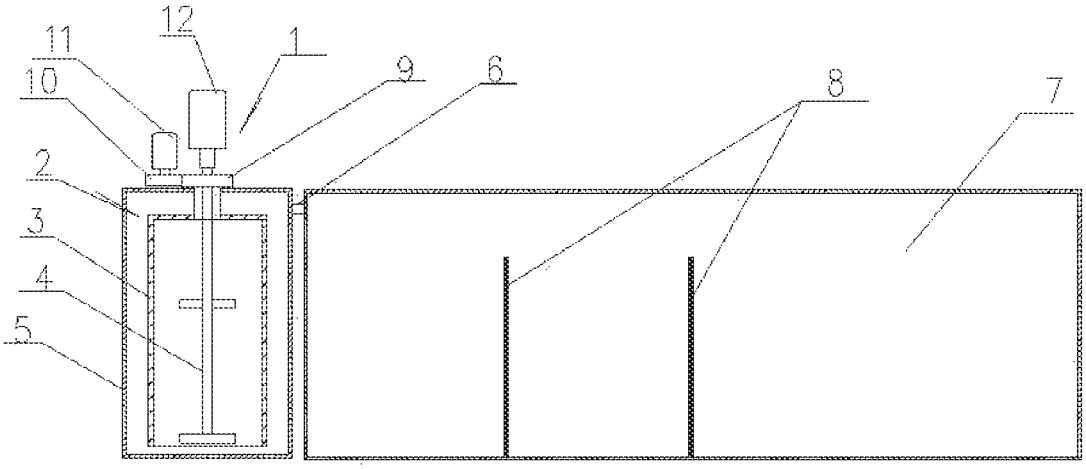

FIG. 2 is a schematic diagram of a front-view sectional structure of an embodiment of an extraction device of the present invention.

Figure 3:
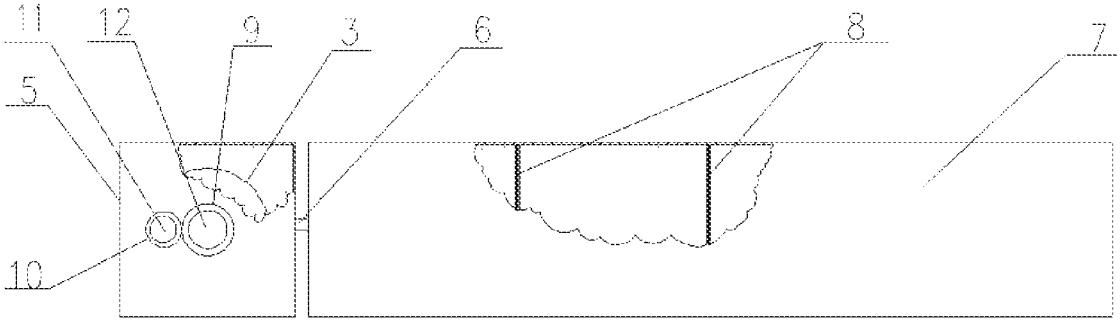

FIG. 3 is a schematic diagram of a top-view structure of the embodiment of the extraction device of the present invention.

Figure 4:
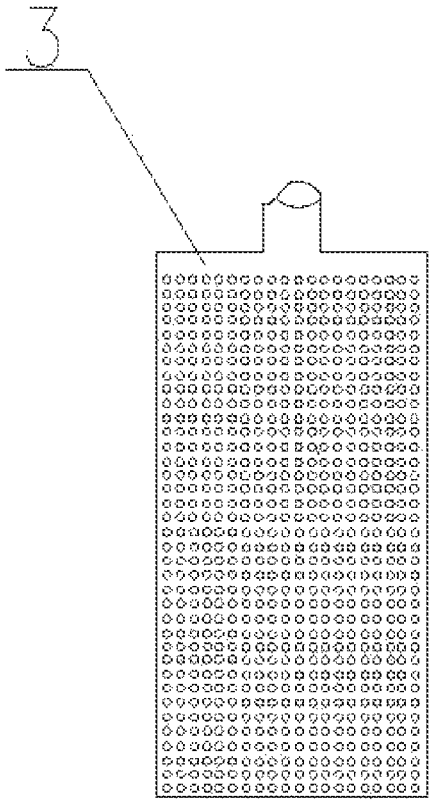

FIG. 4 is a schematic structural diagram of a cylindrical stirring body of the embodiment of the extraction device of the present invention.

Description of reference numerals: 1 refers to main stirrer, 2 refers to auxiliary stirrer, 3 refers to cylindrical stirring body, 4 refers to stirring blade, 5 refers to stirring chamber, 6 refers to transition groove, 7 refers to clarifying chamber, 8 refers to flow stabilization bar, 9 refers to auxiliary stirrer transmission wheel, 10 refers to auxiliary stirrer driving wheel, 11 refers to auxiliary stirrer driving motor, and 12 refers to main stirrer driving motor.

DETAILED DESCRIPTION OF PREFERRED EMBODIMENTS

Optimal Implementations of the Present Invention

A method for extracting and preparing battery-grade lithium carbonate from a P507 raffinate comprises the following steps of impurity adjustment, extraction, purification, reverse extraction, alkalization, crystallization, separation and drying. The impurity adjustment comprises: adjusting a pH value of the P507 raffinate to be 10.0 with lithium hydroxide or alkali, and filtering to obtain a filtrate for later use.

the extraction comprises: mixing the P507 after saponification with the above liquid after impurity adjustment and filtration, standing for phase separation after mixing, retaining an organic phase of the P507, detecting a concentration of lithium ions in a water phase, and sending the water phase for wastewater treatment when the concentration of lithium ions is less than 1 mg/L;

The purification comprises: purifying and washing the organic phase after the step of extraction with 0.2 mol/L lithium sulfate solution, standing for phase separation after washing, retaining an organic phase of the P507, and merging a water phase in the step of extraction.

The reverse extraction comprises: reversely extracting the organic phase of the P507 after purification and washing with dilute sulfuric acid, and carrying out two-phase separation to obtain a blank organic phase and a lithium sulfate solution.

The alkalization comprises: heating the lithium solution obtained by the step of reverse extraction to 90° C., adding lithium hydroxide or alkali to adjust a pH value to be 10.0, maintaining a temperature at 90° C. and standing for 4 hours, and then filtering to obtain a filtrate for later use.

The crystallization comprises: introducing compressed air into the filtrate after alkalization, with a pressure of the compressed air being 0.5 MPa and an air flow rate of the compressed air being 18 $m^3/h$, evaporating and concentrating at the same time, and discharging and cooling when fine crystal particles exist in the concentrated solution.

The reverse extraction comprises: reversely extracting the organic phase of the P507 after purification and washing with dilute liquid alkali, and carrying out two-phase separation to obtain the blank organic phase and a lithium hydroxide solution.

An extraction device for extracting and preparing battery-grade lithium carbonate from a P507 raffinate is provided with a stirring chamber, the stirring chamber is connected with a clarifying chamber through a transition groove, and a stirrer is arranged in the stirring chamber. The stirring chamber is a cube, the clarifying chamber is a cuboid, a length-width ratio of the clarifying chamber is 5:1, a volume ratio of the stirring chamber to the clarifying chamber is 1:5.5, the stirrer consists of a main stirrer and an auxiliary stirrer, the main stirrer is provided with a double-layer cross-shaped stirring blade, the auxiliary stirrer is provided with a cylindrical stirring body, circular small holes with a diameter of 5 mm are evenly distributed in a wall of the cylindrical stirring body, and the stirring blade is sleeved in the cylindrical stirring body. A rotating speed of the main stirrer is 1,200 rpm, and a rotating speed of the auxiliary stirrer 2 is 150 rpm. A diameter of the stirring blade of the main stirrer is 0.3 of a side length of the stirring chamber, and a diameter of the cylindrical stirring body of the auxiliary stirrer is 0.7 of the side length of the stirring chamber. One circular small hole is arranged on the wall every square centimeter. Two slat-shaped flow stabilization bars are sequentially arranged in the clarifying chamber, a distance between a position of a first flow stabilization bar and an inlet end of a transition groove of the clarifying chamber is ¼ of a length of the clarifying chamber, and a distance between a position of a second flow stabilization bar in the length of the clarifying chamber and the inlet end of the transition groove of the clarifying chamber is ½ of the length of the clarifying chamber.

EMBODIMENTS OF INVENTION

Implementations of the Present Invention

In order to understand the present invention more clearly, the present invention is further described hereinafter by specific embodiments with reference to FIG. 1 to FIG. 4.

Implementation 1: as shown in FIG. 1, a method for extracting and preparing battery-grade lithium carbonate from a P507 raffinate comprised the following steps of impurity adjustment, extraction, purification, reverse extraction, alkalization, crystallization, separation and drying. The impurity adjustment comprised: adjusting a pH value of the P507 raffinate to be 8.5 to 10.5 with lithium hydroxide or alkali, and filtering to obtain a filtrate for later use.

The PH value could be adjusted to be 9 to 10, 8.5 to 9, 9 to 9.5 and 9.5 to 10 with the lithium hydroxide or the alkali above.

This step could effectively precipitate and remove impurity cations such as nickel, and experimental data were shown in Table 1.

TABLE 1

Effect table of PH value on precipition and removal of impurity cations such as nickel.

| | PH value | | | | | | |
|---|---|---|---|---|---|---|---|
| | 8.0 | 8.5 | 9.0 | 9.5 | 10.0 | 10.5 | 11.0 |
| Before precipitation | 0.035 g/L | 0.035 g/L | 0.035 g/L | 0.035 g/L | 0.035 g/L | 0.035 g/L | 0.035 g/L |
| After precipitation | 0.011 g/L | 0.009 g/L | 0.005 g/L | 0.002 g/L | 0.001 g/L | 0.001 g/L | 0.001 g/L |
| Precipitation rate | 68.57% | 74.29% | 85.71% | 94.29% | 97.14% | 97.14% | 97.14%. |

The extraction comprised: in the extraction device, mixing the P507 after saponification with the above liquid after impurity adjustment and filtration, standing for phase separation after mixing, retaining an organic phase of the P507, detecting a concentration of lithium ions in a water phase, and sending the water phase for wastewater treatment when the concentration of lithium ions was less than 1 mg/L.

This step could extract lithium from the filtrate into the organic phase to reduce the concentration of lithium ions in the raffinate, thus reducing the difficulty of wastewater treatment.

The purification comprised: in the extraction device, purifying and washing the organic phase after the step of extraction with 0.1 mol/L to 0.25 mol/L lithium sulfate solution, standing for phase separation after washing, retaining an organic phase of the P507, and merging a water phase in the step of extraction.

The above lithium sulfate solution could be 0.12 mol/L to 0.23 mol/L, 15 mol/L to 0.20 mol/L, 0.16 mol/L to 0.18 mol/L, 0.1 mol/L to 0.12 mol/L, 13 mol/L to 0.15 mol/L, 0.16 mol/L to 0.18 mol/L, 0.19 mol/L to 0.20 mol/L, 0.21 mol/L to 0.22 mol/L and 0.23 mol/L to 0.25 mol/L.

This step could wash impurity ions such as sodium entrained in the organic phase, thus improving and purifying the lithium ions in the organic phase. Experimental data were shown in Table 2.

TABLE 2

Effect table of concentration of lithium sulfate solution on removal of impurity ions.

| | Concentration of lithium sulfate solution | | | | | | | | | |
|---|---|---|---|---|---|---|---|---|---|---|
| | 0.1 | 0.13 | 0.15 | 0.17 | 0.19 | 0.20 | 0.22 | 0.23 | 0.25 | 0.26 |
| Removal rate of impurity ions | 77.11% | 88.33% | 89.17% | 93.31% | 97.92% | 98.59% | 98.43% | 98.57% | 98.51% | 98.63%. |

The reverse extraction comprised: in the extraction device, reversely extracting the organic phase of the P507 after purification and washing with dilute sulfuric acid, and carrying out two-phase separation to obtain a blank organic phase and a lithium sulfate solution.

This step could realize the reverse extraction of lithium in the organic phase to obtain lithium salt in a solution state. On one hand, the concentration of lithium ions was increased, and on the other hand, the lithium was further separated from the impurities.

The alkalization comprised: heating the lithium solution obtained by the step of reverse extraction to 85° C. to 95° C., adding lithium hydroxide or alkali to adjust a pH value to be 9.0 to 13.0, maintaining a temperature at 85° C. to 95° C. and standing for 2 hours to 8 hours, and then filtering to obtain a filtrate for later use.

The lithium solution could be heated to 85° C. to 86° C., 87° C. to 88° C., 89° C. to 90° C., 91° C. to 92° C. and 93° C. to 94° C.

The PH value could be adjusted to be 9.5 to 10.0, 10.5 to 11.0, 11.5 to 12.0 and 12.5 to 13.0 by adding the lithium hydroxide or the alkali above.

The above temperature could be maintained at 85° C. to 86° C., 87° C. to 88° C., 89° C. to 90° C., 91° C. to 92° C. and 93° C. to 94° C.

The above standing could last for 2 hours to 3 hours, 4 hours to 5 hours and 6 hours to 7 hours.

This step of alkalization could alkalize the lithium ions to remove the organic phase and easy-to-precipitate impurities from the lithium solution. Experimental data were shown in Table 3, Table 4 and Table 5.

TABLE 3

Organic content and removal effect table of lithium solution at different reaction temperatures under standing for 4 hours at PH value of 11.0.

| | Reaction temperature | | | | | |
|---|---|---|---|---|---|---|
| | 75° C. | 80° C. | 85° C. | 90° C. | 95° C. | 98° C. |
| Organic phase before treatment of lithium solution | 117 mg/L | 117 mg/L | 117 mg/L | 117 mg/L | 117 mg/L | 117 mg/L |
| Organic phase after treatment of lithium solution | 67 mg/L | 43 mg/L | 31 mg/L | 21 mg/L | 21 mg/L | 21 mg/L. |

TABLE 4

Organic content and removal effect table of lithium solution at different PH values under standing for 4 hoirs at 90° C.

| | PH value of reaction | | | | | | | |
|---|---|---|---|---|---|---|---|---|
| | 9.5 | 10.0 | 10.5 | 11.0 | 11.5 | 12.0 | 12.5 | 13.0 |
| Organic phase before treatment of lithium solution | 117 mg/L | 117 mg/L | 117 mg/L | 117 mg/L | 117 mg/L | 117 mg/L | 117 mg/L | 117 mg/L |
| Organic phase after treatment of lithium solution | 37 mg/L | 26 mg/L | 24 mg/L | 21 mg/L | 19 mg/L | 19 mg/L | 19 mg/L | 17 mg/L. |

TABLE 5

Organic content and removal effect table of lithium solution under different standing times at PH value of 11.0 and 90° C.

| | Standing time | | | | | | |
|---|---|---|---|---|---|---|---|
| | 2 | 3 | 4 | 5 | 6 | 7 | 8 |
| Organic phase before treatment of lithium solution | 117 mg/L | 117 mg/L | 117 mg/L | 117 mg/L | 117 mg/L | 117 mg/L | 117 mg/L |
| Organic phase after treatment of lithium solution | 53 mg/L | 35 mg/L | 21 mg/L | 19 mg/L | 17 mg/L | 17 mg/L | 15 mg/L. |

The crystallization comprised: introducing compressed air into the filtrate after alkalization, with a pressure of the compressed air being 0.2 MPa to 0.8 MPa and an air flow rate of the compressed air being 8 $m^3/h$ to 30 $m^3/h$, evaporating and concentrating at the same time, and discharging and cooling when fine crystal particles existed in the concentrated solution.

The above pressure of the compressed air could be 0.2 MPa to 0.3 MPa, 0.4 MPa to 0.5 MPa and 0.6 MPa to 0.7 MPa.

The above air flow rate of the compressed air could be 8 $m^3/h$ to 10 $m^3/h$, 11 $m^3/h$ to 13 $m^3/h$, 14 $m^3/h$ to 16 $m^3/h$, 17 $m^3/h$ to 19 $m^3/h$, 20 $m^3/h$ to 22 $m^3/h$, 23 $m^3/h$ to 25 $m^3/h$, 26 $m^3/h$ to 28 $m^3/h$ and 29 $m^3/h$ to 30 $m^3/h$.

This step of crystallization could carbonize the lithium ions, so that the lithium was converted into the lithium carbonate under an action of carbon dioxide in the compressed air. Experimental data were shown in Table 6 and Table 7.

TABLE 6

Effect table of time required for complete conversion of lithium under different pressures at flow rate of compressed air of 20 $m^3/h$.

| | Pressure of compressed air | | | | | | |
|---|---|---|---|---|---|---|---|
| | 0.2 | 0.3 | 0.4 | 0.5 | 0.6 | 0.7 | 0.8 |
| Conversion time | 498 minutes | 352 minutes | 296 minutes | 194 minutes | 145 minutes | 123 minutes | 110 minutes. |

TABLE 7

Effect table of time required for complete conversion of lithium at different flow rates under pressure of compressed air of 0.7 MPa.

| | Flow rate of compressed air | | | | | |
|---|---|---|---|---|---|---|
| | 5 | 10 | 15 | 20 | 25 | 30 |
| Conversion time | 408 minutes | 312 minutes | 226 minutes | 123 minutes | 111 minutes | 107 minutes. |

In another embodiment, the reverse extraction comprised: in the extraction device, reversely extracting the organic phase of the P507 after purification and washing with dilute alkali, and carrying out two-phase separation to obtain the blank organic phase and a lithium hydroxide solution.

The alkali in the above embodiment could be one or more of sodium hydroxide, potassium hydroxide and ammonium hydroxide.

Implementation 1 has the technical effects that: the concentration of lithium ions in the raffinate can be reduced to 1 mg/L, which significantly reduces the difficulty of wastewater treatment; the recycling rate of lithium is improved, and the recycling rate of lithium is more than 99%; the purity of lithium salt solution is improved, which ensures that the quality of the lithium carbonate product produced by precipitation meets battery-grade requirements; and the introduction of impurity ions is avoided, so that the purity of the product is further ensured and improved, and the lithium carbonate product completely meets of battery-grade requirements.

Implementation 2: as shown in FIG. 1, a method for extracting and preparing battery-grade lithium carbonate from a P507 raffinate comprised the following steps. a. Impurity adjustment comprised: adjusting a pH value of the P507 raffinate to be 8.5 to 10.5, preferably 9 to 10, and 9.5, with lithium hydroxide or alkali, and filtering to obtain a filtrate for later use. Impurity cations such as nickel could be precipitated and removed.

b. Extraction comprised: in the extraction device, mixing the P507 after saponification with the above liquid after filtration in the above step, standing for phase separation after mixing, retaining an organic phase (loaded organic phase) of the P507, detecting a concentration of lithium ions in a water phase (raffinate), and sending the water phase for wastewater treatment when the concentration of lithium ions was less than 1 mg/L. This step could extract lithium from the filtrate into the organic phase to reduce the concentration of lithium ions in the raffinate, thus reducing the difficulty of wastewater treatment.

c. Purification comprised: in the extraction device, purifying and washing the organic phase (loaded organic phase) in the above step with 0.1 mol/L to 0.25 mol/L lithium sulfate solution, preferably 0.1 mol/L to 0.25 mol/L lithium sulfate solution and 0.1 mol/L to 0.20 mol/L lithium sulfate solution, standing for phase separation after washing, retaining an organic phase of the P507, and merging a water phase in the above step. This step could wash impurity ions such as sodium entrained in the organic phase, thus improving and purifying the lithium ions in the organic phase.

d. Reverse extraction comprised: in the extraction device, reversely extracting the organic phase of the P507 after purification and washing with dilute sulfuric acid (or dilute liquid alkali), and carrying out two-phase separation to obtain a blank organic phase and a lithium sulfate (or lithium hydroxide) solution. This step could realize the reverse extraction of lithium in the organic phase to obtain lithium salt in a solution state. On one hand, the concentration of lithium ions was increased, and on the other hand, the lithium was further separated from the impurities.

e. Alkalization comprised: heating the lithium solution in the above step to 85° C. to 95° C., preferably 90° C., adding lithium hydroxide (or alkali) to adjust a pH value to be 9.0 to 13.0, preferably 9.5 to 12.5, 10.0 to 12.0, 10.5 to 11.5, and 11, maintaining a temperature at 85° C. to 95° C., preferably 90° C., and standing for 2 hours to 8 hours, preferably 3 hours to 7 hours, 4 hours to 6 hours, and 5 hours, and then filtering to obtain a filtrate for later use. This step could alkalize the lithium ions to remove the organic phase and easy-to-precipitate impurities from the lithium solution.

f. Crystallization comprised: introducing compressed air into the filtrate after alkalization, with a pressure of the compressed air being 0.2 MPa to 0.8 MPa, preferably 0.3 MPa to 0.7 MPa, 0.4 MPa to 0.6 MPa, and 0.5 MPa, and an air flow rate of the compressed air being 8 $m^3/h$ to 30 $m^3/h$, preferably 10 $m^3/h$ to 25 $m^3/h$, 13 $m^3/h$ to 22 $m^3/h$, 15 $m^3/h$ to 20 $m^3/h$, and 16 $m^3/h$ to 18 $m^3/h$, evaporating and concentrating at the same time, and discharging and cooling when fine crystal particles existed in the concentrated solution.

g. Separation comprised: cooling the concentrated solution to a normal temperature, and centrifugally separating the solution, wherein a solid was lithium carbonate, and a liquid returned to the previous step to continue to participate in the reaction.

h. Drying comprised: drying the solid after centrifugal separation conventionally to obtain battery-grade lithium carbonate.

In Implementation 2, by adopting the above extraction method, the concentration of lithium ions in the raffinate is as low as 1 mg/L, which significantly reduces the difficulty of wastewater treatment; by adopting the extraction method and the alkalization-air precipitation method, the recycling rate of lithium is improved, and the recycling rate of lithium is more than 99%; by adopting the extraction and separation method, the purity of lithium salt solution is improved, which ensures that the quality of the lithium carbonate product produced by precipitation meets battery-grade requirements; and by adopting the alkalization-air precipitation method, the introduction of impurity ions is avoided, so that the purity of the product is further ensured and improved, and the lithium carbonate product completely meets of battery-grade requirements.

Implementation 3: as shown in FIG. 2 to FIG. 4, an extraction device for extracting and preparing battery-grade lithium carbonate from a P507 raffinate is provided with a stirring chamber 5, the stirring chamber 5 is connected with a clarifying chamber 7 through a transition groove 6, and a stirrer is arranged in the stirring chamber 5. The stirring chamber 5 is a cube, the clarifying chamber 7 is a cuboid, a length-width ratio of the clarifying chamber 7 is 4 to 5:1, a volume ratio of the stirring chamber 5 to the clarifying chamber 7 is 1:4.5 to 5.5, the stirrer consists of a main stirrer 1 and an auxiliary stirrer 2, the main stirrer 1 is provided with a stirring blade 4, the stirring blade 4 is double-layer cross-shaped, the auxiliary stirrer 2 is provided with a cylindrical stirring body 3, circular small holes with a diameter of 5 mm to 10 mm are evenly distributed in a wall of the cylindrical stirring body 3, and the stirring blade 4 is sleeved in the cylindrical stirring body 3.

In another solution, a rotating speed of the main stirrer 1 is 1,000 rpm to 2,000 rpm, and may also be 1,100 rpm to 1,300 rpm, 1,400 rpm to 1,500 rpm, 1,600 rpm to 1,700 rpm, and 1,800 rpm to 1,900 rpm. A rotating speed of the auxiliary stirrer 2 is 100 rpm to 200 rpm, and may also be 110 rpm to 120 rpm, 130 rpm to 140 rpm, 150 rpm to 160 rpm, 170 rpm to 180 rpm, and 190 rpm. The function is that: the main stirrer runs at a high speed for full mixing and quick balance of two phases, thus achieving a better extraction effect. The auxiliary stirrer has a low rotating speed and is cylindrical, which can reduce a moving speed of the mixed fluid running at a high speed in the main stirrer, and break phase continuity, thus being more conducive to phase separation subsequently.

In another solution, a maximum diameter of the stirring blade 4 of the main stirrer 1 is 0.28 to 0.33 of a side length of the stirring chamber 5, and a diameter of the cylindrical stirring body 3 of the auxiliary stirrer is 0.65 to 0.75 of the side length of the stirring chamber 5. The function is that: the larger the stirring blade is, the stronger the stirring intensity is, when the stirring blade is larger than the ratio, a motor load can be increased on one hand, and the two phases may have emulsification and a large amount of suction air if the stirring intensity is too strong on the other hand, resulting in the increase of the difficulty of subsequent phase separation, and the suction air may cause accumulation of a large number of bubbles in the mixed solution, which will affect an extraction effect and increase the difficulty of phase separation.

In another solution, two slat-shaped flow stabilization bars 8 are sequentially arranged in the clarifying chamber 7, a distance between a position of a first flow stabilization bar and an inlet end of a transition groove 6 of the clarifying chamber 7 is ¼ of a length of the clarifying chamber, and a distance between a position of a second flow stabilization bar in the length of the clarifying chamber 7 and the inlet end of the transition groove 6 of the clarifying chamber 7 is ½ of the length of the clarifying chamber 7. The function is that: the flow stabilization bars are used to reduce a flow velocity of the mixed solution, thus accelerating the phase separation of the two phases. If the first flow stabilization bar is too close to the inlet of the transition groove, a torrent may be caused, and there may be a possibility of flooding (the mixed solution in the groove is blocked too early and stirred up to form waves and flood out of the groove), and if the first flow stabilization bar is too long, the first flow stabilization bar will not work and will affect an effect of the second flow stabilization bar. If the second flow stabilization bar is too close to the inlet of the transition groove, after the fluid flows through the first flow stabilization bar, the flow velocity has been reduced, and the fluid immediately encounters the second flow stabilization bar, and forms a vortex flow between the two bars again, which affects the phase separation of the two phases. If the second flow stabilization bar is too far away from the inlet of the transition groove, after the fluid flows through the first flow stabilization bar, the flow velocity has been reduced, and the second flow stabilization bar basically loses its due role.

An extraction principle of the extraction device for extracting and preparing the battery-grade lithium carbonate from the P507 raffinate is that: the organic phase and the lithium-containing water phase are strongly mixed under the high-speed running of the main stirrer, and the lithium is transferred from the water phase to the organic phase. When the two phases after mixing collide with the auxiliary stirrer rapidly under an action of centrifugal force, fine holes in the auxiliary stirrer disperse the mixed phases under movement of the auxiliary stirrer and reduce the flow velocity, so as to achieve functions of destruction and stirring, thus ensuring the extraction effect. The mixed solution enters the clarifying chamber through the transition groove, the clarifying chamber is mainly used to separate the two phases, and the bars are arranged to reduce the flow velocity of the fluid and accelerate the phase separation.

The extraction device for extracting and preparing the battery-grade lithium carbonate from the P507 raffinate above has the beneficial effects that: when lithium is extracted with an extracting agent, a capacity of the extracting agent is affected due to characteristics of lithium, so that a rapid reaction is needed to increase a production capacity of the extraction groove. The extraction groove increases the stirring intensity on the basis of traditional extraction, and meanwhile, the auxiliary stirrer is used to break emulsification and phase continuity, and accelerate the phase separation, thus ensuring the production capacity of the extraction groove.

Embodiment 1

A method and device for extracting and preparing battery-grade lithium carbonate from a P507 raffinate were provided, and the method comprised the following steps. a. Ingredients of the P507 raffinate comprised: Li: 1.5 g/L, Fe: 0.0005 g/L, Al: 0.0003 g/L, Zn: 0.0001 g/L, Ni: 0.035 g/L, Cu: 0.0001 g/L, Pb: 0.001 g/L, Ca: 0.0004 g/L, Mg: 0.001 g/L and Na: 3.3 g/L.

b. 100 L of raffinate was taken, a PH value of the raffinate was adjusted to be 9.8 with lithium hydroxide, and the raffinate was filtered.

c. The filtrate in the step b and the P507 after saponification were added into a stirring chamber of the started extraction device, and after passing through the extraction device, the raffinate was taken to analyze and detect that Li was 0.00091 g/L (0.91 mg/L).

d. The organic phase in the step c and 0.25 mol/L lithium sulfate solution were added into the stirring chamber of the started extraction device, and after passing through the extraction device, the water phase flowed to the stirring chamber in the step c.

e. The organic phase in the step d and 2.25 mol/L lithium sulfate solution were added into the stirring chamber of the started extraction device, and after passing through the extraction device, the water phase was a high-concentration lithium solution, and the organic phase was a blank organic phase. 7,950 mL of lithium solution with a concentration of 20.3 g/L was obtained, and an extraction yield was 99.47% after subtracting the lithium hydroxide used for adjusting the PH value.

f. The lithium solution was heated to 92° C., a pH value of the lithium solution was adjusted to be 12.5 with lithium hydroxide, and the lithium solution was maintained at 90° C. to stand for reaction for 2 hours, and then filtered.

g. The filtrate in the step f was added into a reactor, introduced with compressed air after finishing material addition, and heated for evaporation, wherein the compressed air was 0.65 MPa and had a flow rate of 16.3 $m^3$/h. When fine crystals existed in the reactor, the introduction of the compressed air and the heating were stopped, and the lithium solution in the reactor was discharged and cooled.

h. The lithium solution was separated and dried after being cooled to room temperature, and the mother solution continuously returned to the step g to participate in the reaction. Therefore, a comprehensive yield of lithium was 99.47%.

Analysis and detection results of lithium carbonate after drying were as follows: $Li_2CO_3$: 99.61%, Fe: 0.0001%, Al: 0.0002%, Zn: 0.0001%, Ni: 0.0007%, Cu: 0.0001%, Pb: 0.0001%, Ca: 0.0004%, Mg: 0.0011%, Na: 0.0023%, K: 0.0003%, Si: 0.0012%, $SO_4^{2-}$: 0.017%, and $Cl^-$: 0.001%.

Embodiment 2

A method and device for extracting and preparing battery-grade lithium carbonate from a P507 raffinate were provided, and the method comprised the following steps.

a. Ingredients of the P507 raffinate comprised: Li: 2.35 g/L, Fe: 0.0002 g/L, Al: 0.0009 g/L, Zn: 0.0003 g/L, Ni: 0.017 g/L, Cu: 0.0001 g/L, Pb: 0.00 g/L, Ca: 0.0005 g/L, Mg: 0.0012 g/L and Na: 2.12 g/L.

b. 100 L of raffinate was taken, a PH value of the raffinate was adjusted to be 10.2 with lithium hydroxide, and the raffinate was c. The filtrate in the step b and the P507 after saponification were added into a stirring chamber of the started extraction device, and after passing through the extraction device, the raffinate was taken to analyze and detect that Li was 0.00077 g/L (0.77 mg/L).

d. The organic phase in the step c and 0.18 mol/L lithium sulfate solution were added into the stirring chamber of the started extraction device, and after passing through the extraction device, the water phase flowed to the stirring chamber in the step c.

e. The organic phase in the step d and 2.13 mol/L lithium sulfate solution were added into the stirring chamber of the started extraction device, and after passing through the extraction device, the water phase was a high-concentration lithium solution, and the organic phase was a blank organic phase. 12,050 mL of lithium solution with a concentration of 19.43 g/L was obtained, and an extraction yield was 99.63% after subtracting the lithium hydroxide used for adjusting the PH value.

f. The lithium solution was heated to 95° C., a pH value of the lithium solution was adjusted to be 12.5 with lithium hydroxide, and the lithium solution was maintained at 95° C. to stand for reaction for 2 hours, and then filtered.

g. The filtrate in the step f was added into a reactor, introduced with compressed air after finishing material addition, and heated for evaporation, wherein the compressed air was 0.70 MPa and had a flow rate of 18.2 $m^3$/h. When fine crystals existed in the reactor, the introduction of the compressed air and the heating were stopped, and the lithium solution in the reactor was discharged and cooled.

h. The lithium solution was separated and dried after being cooled to room temperature, and the mother solution continuously returned to the step g to participate in the reaction. Therefore, a comprehensive yield of lithium was 99.63%.

i. Analysis and detection results of lithium carbonate after drying were as follows: $Li_2CO_3$: 99.58%, Fe: 0.0006%, Al: 0.0007%, Zn: 0.0005%, Ni: 0.0002%, Cu: 0.0005%, Pb: 0.0005%, Ca: 0.0006%, Mg: 0.0009%, Na: 0.0011%, K: 0.0003%, Si: 0.0017%, $SO_4^{2-}$0.041% and $Cl^-$0.001%.

Embodiment 3

A method and device for extracting and preparing battery-grade lithium carbonate from a P507 raffinate were provided, and the method comprised the following steps.

a. Ingredients of the P507 raffinate comprised: Li: 0.93 g/L, Fe: 0.0005 g/L, Al: 0.0005 g/L, Zn: 0.0001 g/L, Ni: 0.055 g/L, Cu: 0.0005 g/L, Pb: 0.003 g/L, Ca: 0.0005 g/L, Mg: 0.0007 g/L and Na: 1.37 g/L.

b. 100 L of raffinate was taken, a PH value of the raffinate was adjusted to be 9.5 with lithium hydroxide, and the raffinate was filtered.

c. The filtrate in the step b and the P507 after saponification were added into a stirring chamber of the started extraction device, and after passing through the extraction device, the raffinate was taken to analyze and detect that Li was 0.00083 g/L (0.83 mg/L).

d. The organic phase in the step c and 0.22 mol/L lithium sulfate solution were added into the stirring chamber of the started extraction device, and after passing through the extraction device, the water phase flowed to the stirring chamber in the step c.

e. The organic phase in the step d and 2.01 mol/L lithium sulfate solution were added into the stirring chamber of the started extraction device, and after passing through the extraction device, the water phase was a high-concentration lithium solution, and the organic phase was a blank organic phase. 4,860 mL of lithium solution with a concentration of 19.11 g/L was obtained, and an extraction yield was 99.86% after subtracting the lithium hydroxide used for adjusting the PH value.

f. The lithium solution was heated to 90° C., a pH value of the lithium solution was adjusted to be 12.2 with lithium hydroxide, and the lithium solution was maintained at 90° C. to stand for reaction for 2 hours, and then filtered.

g. The filtrate in the step f was added into a reactor, introduced with compressed air after finishing material addition, and heated for evaporation, wherein the compressed air was 0.55 MPa and had a flow rate of 21.2 $m^3/h$. When fine crystals existed in the reactor, the introduction of the compressed air and the heating were stopped, and the lithium solution in the reactor was discharged and cooled.

h. The lithium solution was separated and dried after being cooled to room temperature, and the mother solution continuously returned to the step g to participate in the reaction. Therefore, a comprehensive yield of lithium was 99.86%.

i. Analysis and detection results of lithium carbonate after drying were as follows: $Li_2CO_3$: 99.59%, Fe: 0.0007%, Al: 0.0005%, Zn: 0.0003%, Ni: 0.0005%, Cu: 0.0001%, Pb: 0.0006%, Ca: 0.0005%, Mg: 0.0005%, Na: 0.0013%, K: 0.0005%, Si: 0.0032%, $SO_4^{2-}$: 0.033% and $Cl^-$: 0.001%.

Embodiment 4

A method and device for extracting and preparing battery-grade lithium carbonate from a P507 raffinate were provided, and the method comprised the following steps.

a. Ingredients of the P507 raffinate comprised: Li: 5.5 g/L, Fe: 0.001 g/L, Al: 0.0011 g/L, Zn: 0.0021 g/L, Ni: 0.075 g/L, Cu: 0.0023 g/L, Pb: 0.001 g/L, Ca: 0.0016 g/L, Mg: 0.001 g/L and Na: 5.3 g/L.

b. 100 L of raffinate was taken, a PH value of the raffinate was adjusted to be 10.5 with lithium hydroxide, and the raffinate was c. The filtrate in the step b and the P507 after saponification were added into a stirring chamber of the started extraction device, and after passing through the extraction device, the raffinate was taken to analyze and detect that Li was 0.00033 g/L (0.33 mg/L).

d. The organic phase in the step c and 0.19 mol/L lithium sulfate solution were added into the stirring chamber of the started extraction device, and after passing through the extraction device, the water phase flowed to the stirring chamber in the step c.

e. The organic phase in the step d and 2.15 mol/L lithium sulfate solution were added into the stirring chamber of the started extraction device, and after passing through the extraction device, the water phase was a high-concentration lithium solution, and the organic phase was a blank organic phase. 27,350 mL of lithium solution with a concentration of 20.17 g/L was obtained, and an extraction yield was 99.66% after subtracting the lithium hydroxide used for adjusting the PH value.

f. The lithium solution was heated to 95° C., a pH value of the lithium solution was adjusted to be 11.9 with lithium hydroxide, and the lithium solution was maintained at 90° C. to stand for reaction for 2 hours, and then filtered.

g. The filtrate in the step f was added into a reactor, introduced with compressed air after finishing material addition, and heated for evaporation, wherein the compressed air was 0.75 MPa and had a flow rate of 18.3 $m^3/h$. When fine crystals existed in the reactor, the introduction of the compressed air and the heating were stopped, and the lithium solution in the reactor was discharged and cooled.

h. The lithium solution was separated and dried after being cooled to room temperature, and the mother solution continuously returned to the step g to participate in the reaction. Therefore, a comprehensive yield of lithium was 99.66%.

i. Analysis and detection results of lithium carbonate after drying were as follows: $Li_2CO_3$: 99.53%, Fe: 0.0005%, Al: 0.0007%, Zn: 0.0005%, Ni: 0.0005% Cu: 0.0005%, Pb: 0.0003%, Ca: 0.0009%, Mg: 0.0017%, Na: 0.0037%, K: 0.0001%, Si: 0.0019%, $SO_4^{2-}$:0.023% and $Cl^-$:0.001%.

Embodiment 5 as shown in FIG. 2 to FIG. 4, an extraction device for extracting and preparing battery-grade lithium carbonate from a P507 raffinate is provided with a stirring chamber 5, the stirring chamber 5 is connected with a clarifying chamber 7 through a transition groove 6, and a stirrer is arranged in the stirring chamber 5. The stirring chamber 5 is a cube, the clarifying chamber 7 is a cuboid, a length-width ratio of the clarifying chamber 7 is 4 to 5:1, a volume ratio of the stirring chamber to the clarifying chamber 7 is 1:4.5 to 5.5, the stirrer consists of a main stirrer 1 and an auxiliary stirrer 2, the main stirrer 1 is provided with a stirring blade 4, the stirring blade 4 is double-layer cross-shaped, the auxiliary stirrer 2 is provided with a cylindrical stirring body 3, circular small holes with a diameter of 5 mm to 10 mm are evenly distributed in a wall of the cylindrical stirring body 3, and the stirring blade 4 is sleeved in the cylindrical stirring body 3.

Embodiment 6 as shown in FIG. 2 to FIG. 4, an extraction device for extracting and preparing battery-grade lithium carbonate from a P507 raffinate is provided with a stirring chamber 5, the stirring chamber 5 is connected with a clarifying chamber 7 through a transition groove 6, and a stirrer is arranged in the stirring chamber 5. The stirring chamber 5 is a cube, the clarifying chamber 7 is a cuboid, a length-width ratio of the clarifying chamber 7 is 4 to 5:1, a volume ratio of the stirring chamber to the clarifying chamber 7 is 1:4.5 to 5.5, the stirrer consists of a main stirrer 1 and an auxiliary stirrer 2, the main stirrer 1 consists of a main stirrer driving motor 12 and a stirring blade 4, and the stirring blade 4 is double-layer cross-shaped. The auxiliary stirrer 2 consists of an auxiliary stirrer driving motor 11, an auxiliary stirrer driving wheel 10 in driving connection with the driving motor 11, an auxiliary stirrer transmission wheel 9 in transmission connection with the driving wheel 10, and a cylindrical stirring body 3 connected with the transmission wheel 9. The auxiliary stirrer transmission wheel 9 is provided with a center hole, and a shaft of the stirring blade 4 of the main stirrer 1 penetrates through the center hole of the transmission wheel 9. A support bearing is placed under the transmission wheel 9. The driving wheel 10 and the transmission wheel 9 are in gear connection or friction connection. The main stirrer driving motor 12 and the auxiliary stirrer driving motor 11 are fixed on a top cover of the stirring chamber 5 through brackets. A rotating speed of the main stirrer 1 is 1,000 rpm to 2,000 rpm, and a rotating speed of the auxiliary stirrer 2 is 100 rpm to 200 rpm. A maximum diameter of the stirring blade 4 of the main stirrer 1 is 0.28 to 0.33 of a side length of the stirring chamber 5, and a diameter of the cylindrical stirring body 3 of the auxiliary stirrer 2 is 0.65 to 0.75 of the side length of the stirring chamber 5. Circular small holes with a diameter of 5 mm to 10 mm are evenly distributed in a wall of the cylindrical stirring body 3. One circular small hole is arranged every square centimeter. The stirring blade 4 is sleeved in the cylindrical stirring body 3. two slat-shaped flow stabilization bars 8 are staggered in the clarifying chamber, a distance between a position of a left first flow stabilization bar and an inlet end of a transition groove 6 of the clarifying chamber 7 is ¼ of a length of the clarifying chamber 7, and a distance between a position of a right second flow stabilization bar in the length of the clarifying chamber 7 and the inlet end of the transition groove 6 of the clarifying chamber 7 is ½ of the length of the clarifying chamber 7. The flow stabilization bars 8 are conventional bars.

The above are only the preferred embodiments of the present invention and are not intended to limit the present invention. For those skilled in the art, the present invention may have various modifications and changes. Any modification, equivalent substitution, improvement, etc. made within the spirit and principle of the present invention are included in the scope of protection of the present invention.

INDUSTRIAL APPLICABILITY

The present invention has been put into industrial production and application, the recycling rate of lithium is more than 99%, and the prepared lithium carbonate product meets battery-grade lithium carbonate standard requirements.

We claim:

1. A method for extracting and preparing lithium carbonate from a raffinate of P507, comprising operations of impurity adjustment, extraction, purification, reverse extraction, alkalization, crystallization, separation, and drying;

wherein the operation of impurity adjustment comprises: adjusting a pH value of the raffinate of P507 to be 8.5 to 10.5 with lithium hydroxide or alkali, and performing filtering to obtain a filtrate for subsequent use;

wherein the operation of extraction comprises: mixing the P507 after saponification with the above liquid after impurity adjustment and filtration, standing for phase separation after mixing, retaining an organic phase of the P507, detecting a concentration of lithium ions in a water phase, and sending the water phase for wastewater treatment when the concentration of lithium ions is less than 1 mg/L;

wherein the operation of purification comprises: purifying and washing the organic phase after extraction with 0.1 mol/L to 0.25 mol/L lithium sulfate solution, standing for phase separation after washing, retaining an organic phase of the P507, and merging a water phase in the extraction;

wherein the operation of reverse extraction comprises: reversely extracting the organic phase of the P507 after purification and washing with sulfuric acid, and carrying out two-phase separation to obtain a blank organic phase and a lithium sulfate solution;

wherein the operation of alkalization comprises: heating the lithium solution to 85° C. to 95° C., adding lithium hydroxide or alkali to adjust a pH value to be 9.0 to 13.0, maintaining a temperature at 85° C. to 95° C. and standing for 2 hours to 8 hours, and then performing filtering to obtain a filtrate for later use; and wherein the operation of crystallization comprises: introducing compressed air into the filtrate after alkalization, with a pressure of the compressed air being 0.2 MPa to 0.8 MPa and an air flow rate of the compressed air being 8 $m^3/h$ to 30 $m^3/h$, performing evaporating and concentrating at the same time, and discharging and cooling when fine crystals exist in the concentrated solution.

2. The method according to claim 1, wherein the impurity adjustment comprises: adjusting the pH value of the P507 raffinate to be 9 to 10 with the lithium hydroxide or the alkali, and filtering to obtain the filtrate for later use.

3. The method according to claim 1, wherein in the step of purification, the organic phase after extraction is purified and washed with 0.15 mol/L to 0.20 mol/L lithium sulfate solution.

4. The method according to claim 1, wherein the reverse extraction comprises: reversely extracting the organic phase of the P507 after purification and washing with liquid alkali, and carrying out two-phase separation to obtain the blank organic phase and a lithium hydroxide solution.

5. The method according to claim 1, wherein the alkalization comprises: heating the lithium solution to 90° C., adding the lithium hydroxide or the alkali to adjust the pH value to be 10.0 to 12.0, maintaining the temperature at 90° C. and standing for 4 hours to 6 hours, and then filtering to obtain the filtrate for later use.

6. The method according to claim 1, wherein in the step of crystallization, the pressure of the compressed air is 0.4 MPa to 0.6 MPa, and the air flow rate of the compressed air is 10 $m^3/h$ to 20 $m^3/h$.

* * * * *